US012637116B2

(12) United States Patent
Ulbricht et al.

(10) Patent No.: US 12,637,116 B2
(45) Date of Patent: May 26, 2026

(54) BOGIE FOR A RAILWAY VEHICLE WITH ROLL STABILISER

(71) Applicants: CRRC QINGDAO SIFANG CO., LTD., Qingdao (CN); CG RAIL—CHINESISCH-DEUTSCHES FORSCHUNGS- UND ENTWICKLUNGSZENTRUM FÜR BAHN- UND VERKEHRSTECHNIK DRESDEN GMBH, Dresden (DE)

(72) Inventors: Andreas Ulbricht, Dresden (DE); Werner Hufenbach, Dresden (DE); Florian Zeidler, Dresden (DE); Sansan Ding, Qingdao (CN); Zhenxian Zhang, Qingdao (CN); Yulong Gao, Qingdao (CN); Xiongfei Zhang, Qingdao (CN); Dawei Ruan, Qingdao (CN); Chao Su, Qingdao (CN); Kejian Liu, Qingdao (CN); Xin Cao, Qingdao (CN)

(73) Assignees: CRRC QINGDAO SIFANG CO., LTD., Qingdao (CN); CG RAIL—CHINESISCH-DEUTSCHES FORSCHUNGS- UND ENTWICKLUNGSZENTRUM FÜR BAHN- UND VERKEHRSTECHNIK DRESDEN GMBH, Dresden (DE)

( * ) Notice: Subject to any disclaimer, the term of this patent is extended or adjusted under 35 U.S.C. 154(b) by 826 days.

(21) Appl. No.: 17/995,769

(22) PCT Filed: Mar. 29, 2021

(86) PCT No.: PCT/EP2021/058170
§ 371 (c)(1),
(2) Date: Oct. 26, 2022

(87) PCT Pub. No.: WO2021/204583
PCT Pub. Date: Oct. 14, 2021

(65) Prior Publication Data

US 2023/0166777 A1 Jun. 1, 2023

(30) Foreign Application Priority Data

Apr. 9, 2020 (DE) ..... 10 2020 109 930.4

(51) Int. Cl.
*B61F 5/24* (2006.01)
*B61F 5/14* (2006.01)
(Continued)

(52) U.S. Cl.
CPC ..... *B61F 5/24* (2013.01); *B61F 5/14* (2013.01); *B61F 5/304* (2013.01); *B61F 5/52* (2013.01)

(58) Field of Classification Search
CPC ..... B61F 5/38; B61F 5/24; B61F 5/52; B61F 5/304; B61F 5/14; B61F 3/02; B61F 5/30
See application file for complete search history.

(56) References Cited

U.S. PATENT DOCUMENTS 2,191,408 A * 2/1940 Maris ..... B61F 5/24 105/210
5,222,442 A * 6/1993 Tack, Jr. ..... B61F 5/36 105/182.1
(Continued)

FOREIGN PATENT DOCUMENTS

CH 677763 A5 6/1991
CN 203005448 U * 6/2013
(Continued)

OTHER PUBLICATIONS

First Office Action dated Oct. 16, 2023 for Japanese patent application No. 2022-561994.
(Continued)

*Primary Examiner* — S. Joseph Morano
*Assistant Examiner* — Cheng X Lin
(74) *Attorney, Agent, or Firm* — Yue (Robert) Xu; Apex Attorneys at Law, LLP

(57) ABSTRACT

The invention relates to a bogie for a rail vehicle characterized by a high lightweight construction potential. The bogie (1, 1*, 1**) according to the invention has, for
(Continued)

Figure 1:
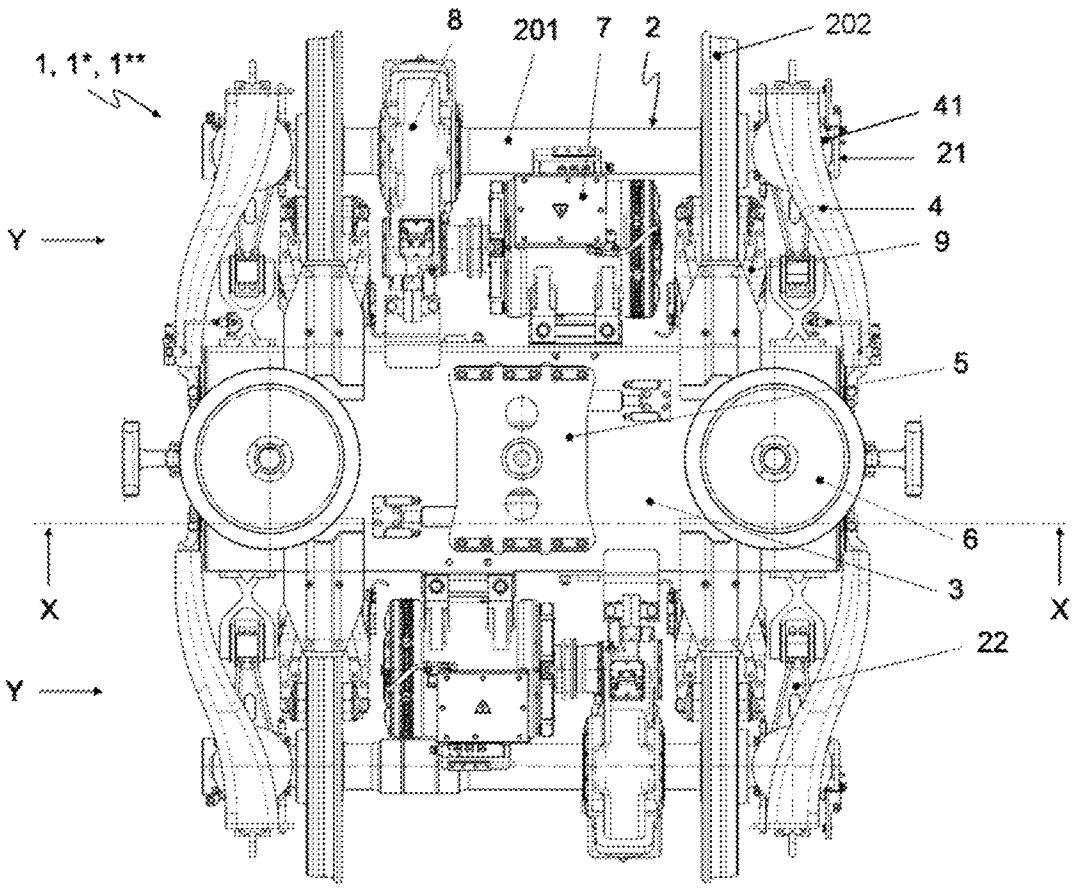

primary suspension, a torsion spring system (12) in the inner volume of which a roll stabilizer having a torsion rod (11) is arranged in a torsionally movable manner. The roll stabilizer can be articulated to the car body of the rail vehicle or to the torsion spring system (12). The bogie (1, 1*, 1**) according to the invention advantageously has a particularly large installation space for built-in components.

18 Claims, 10 Drawing Sheets

(51) Int. Cl.
*B61F 5/30* (2006.01)
*B61F 5/52* (2006.01)

(56) References Cited

U.S. PATENT DOCUMENTS

| | | | | |
|---|---|---|---|---|
| 8,701,564 | B2 * | 4/2014 | Schaller | B61F 5/38 105/168 |
| 2012/0279416 | A1 * | 11/2012 | Nishimura | B61F 5/52 105/218.1 |
| 2019/0322296 | A1 * | 10/2019 | Ma | B61F 3/02 |

FOREIGN PATENT DOCUMENTS

| | | | |
|---|---|---|---|
| CN | 205059624 | U | 3/2016 |
| CN | 106627635 | A | 5/2017 |
| DE | 735080 | C | 5/1943 |
| DE | 838897 | C | 5/1952 |
| DE | 2841769 | A1 | 4/1980 |
| DE | 4311521 | C1 | 4/1994 |
| DE | 4410970 | C1 | 7/1995 |
| DE | 102012008995 | A1 | 9/2013 |
| DE | 2952182 | A1 | 6/2018 |
| DE | 102016123784 | A1 | 6/2018 |
| JP | S45-002202 | B | 1/1970 |
| JP | S61-17730 | A | 1/1986 |
| JP | H0924826 | A | 1/1997 |
| JP | 2013086798 | A | 5/2013 |
| JP | 2020509958 | A | 4/2020 |

OTHER PUBLICATIONS

International Search Report and Written Opinion of International Application No. PCT/EP2021/058170, mailed on Jul. 8, 2021 (English Translation).

* cited by examiner

BOGIE FOR A RAILWAY VEHICLE WITH ROLL STABILISER

CROSS REFERENCE TO RELATED APPLICATIONS

This application is a national stage filing under section 371 of International Application No. PCT/EP2021/058170, filed on Mar. 29, 2021, and published on Oct. 14, 2021 as WO 2021/204583, which claims priority to German Application No. 10 2020 109 930.4, filed on Apr. 9, 2020.

The invention relates to a bogie according to the preamble of Claim 1.

Conventional bogies for rail vehicles in a steel construction, in which the primary suspension, i.e., the suspension of the wheels or wheel axles relative to the bogie, is usually effected by leaf springs, coil springs, or rubber-metal springs, in addition to the high tare weight, have additional disadvantages in that they consist of many individual parts and little installation space is available for built-in components, such as drives, control devices, and brakes.

In order to reduce the tare weight, bogies in fiber-composite construction are known from the prior art, the primary suspension in said bogies being realized by the bogie frame, as described, for example, in DE 29 52 182 A1, or by leaf springs made of a fiber-reinforced plastic (FRP), as known, for example, from US 2012/0279416 A1.

The use of FRP in the design of torsion rods, also referred to as torsion bar springs, torsion bars, or torsion springs, offers particular advantages due to the possibility of stress-appropriate fiber orientation, which has the result that in the longitudinal direction of the fibers the elasticity module E enters into the torsional stiffness of a torsion spring made of fiber-composite material and not, as for example in the case of metallic springs, the generally smaller shear modulus G.

For this and other reasons, bogies, in which the primary suspension is realized by means of torsion rods, have a high lightweight construction potential and a large installation space for built-in components. A bogie with a torsion-rod primary suspension, in which the wheel axles are fastened to the frame by control arms swinging in the vertical direction, wherein each control arm is fastened to the outer end of a torsion rod arranged transversely to the direction of travel, is known, for example, from DE 735 080 A or from DE 10 2016 123 784 A1. A similar design is described in DE 838 897 A, wherein the control arms are height-adjustable in the bogie center via an adjustable anchoring of the torsion rods.

In rail vehicles, torsion rods are further used in the transverse stabilization of the car body, i.e., to reduce or stabilize the rolling movement of the car body about its longitudinal axis.

DE 28 41 769 A1 shows a torsion rod acting as a transverse stabilizer, which connects swing arms arranged on opposite sides of the vehicle to each other. The upper bearing of a coil spring for cushioning the car body is fastened vertically movably on each swing arm, which is attached to the bogie frame via a swing-arm holder.

In order to prevent the car body from being deflected to one side, a roll stabilizer in the form of a torsion rod arranged transversely to the direction of travel and having end-side cranks, which are usually mounted pivotably on the car body, is also frequently used, wherein the connection between the cranks and the car body is made via pendulum supports.

DE 44 10 970 C1 describes a combination of a roll stabilizer designed in this way for a rail vehicle, the car body of which rests on the bogie in a spring-loaded manner, with a passive transverse inclination control which is represented by tilting of the pendulum supports of the roll stabilizer and in which the torsion rod of the roll stabilizer is mounted displaceably to both sides by a limited stroke, from a central position centered in the bogie by spring force, transversely to the vehicle longitudinal direction.

DE 10 2012 008 995 A1 shows a stabilizer made of an FRP for the wheel suspension of a motor vehicle, which stabilizer is connected via a force-fitting and form-fitting toothing to longitudinal arms fastened to the wheel suspension.

The object of the invention is to specify a bogie having a roll stabilizer and a particularly large installation space for additional built-in components.

The object is achieved by a bogie for a rail vehicle having the features of Claim 1. Developments of the invention are specified in subordinate claims.

The bogie according to the invention has at least two wheelsets, each wheelset comprising two wheels connected by an axle. The wheelset is mounted in axle bearings which are connected to the frame in an articulated manner via axle guides so that the axle guides form an H shape with the axle bearings and the frame. The frame has at least two torsion spring systems which are arranged parallel to the axles of the wheelsets and are fixedly connected to the frame in regions. Furthermore, the torsion spring systems have spring lever arms at the end so that the end region, not connected to the torsion spring system, of the spring lever arm acts on the axle bearing in each case. In the bogie according to the invention, the primary suspension is accordingly at least partially assumed by the at least two torsion spring systems. The bogie according to the invention moreover has at least one roll stabilizer which has a torsion rod which is arranged in a torsionally movable manner in the inner volume of at least one of the torsion spring systems. Like the torsion spring system, the torsion rod of the roll stabilizer is accordingly arranged transversely to the direction of travel of the bogie, i.e., the central axis of the torsion rod of the roll stabilizer is likewise arranged at least approximately parallel to the axles of the wheelsets.

Each of the at least two torsion spring systems has at least one torsion rod which takes the form of a hollow body. Within the meaning of this application, a torsion spring system may have exactly one torsion rod which, in the region of its half-height, is fixedly mounted in the frame and whose two ends each have a spring lever. A torsion spring system may also have two torsion rods arranged one behind the other in the axial direction. The mutually facing ends of the torsion rods are in that case fixedly mounted on the frame. The other ends of the two torsion rods each have a spring lever.

Due to the arrangement of the torsion rod of the roll stabilizer within the torsion spring system, the bogie according to the invention advantageously has a large installation space for built-in components.

The torsion spring systems may be arranged in corresponding recesses within the frame in a particularly space-saving manner.

In one embodiment of the bogie according to the invention, the end regions of the torsion rod of the roll stabilizer project beyond the torsion spring system at both ends. At least one pendulum support arrangement is arranged on each of the two end regions of the torsion rod of the roll stabilizer, the end, not connected to the torsion rod, of each pendulum support arrangement being articulated to the car body of the rail vehicle so that the two pendulum support arrangements are articulated mechanically and in an energy-transmitting manner to opposite sides of the car body.

In an alternative embodiment of the bogie according to the invention, the torsion rod of the roll stabilizer is articulated to the torsion spring system, which is at least part of the primary suspension of the rail vehicle.

For this purpose, the torsion rod of the roll stabilizer is preferably at least indirectly connected at the end to the torsion spring system in a force-fitting or a force-fitting and form-fitting manner, for example via an end-side press connection or an end-side toothing between the torsion rod of the roll stabilizer and the torsion spring system or between the torsion rod of the roll stabilizer and a transmission element connected to the torsion spring system.

Advantageously, this embodiment offers a particularly large amount of installation space and requires particularly few components and no additional attachments on the car body.

The geometry and the material of the torsion rods of the torsion spring system and of the roll stabilizer can be adapted in a defined manner to the loads to be expected. The torsion rods may, for example, have a round, oval, or polygonal outer cross-sectional contour which may be constant or variable over the length, i.e., along the central axis, of the torsion rods. In order to save mass, the torsion rod of the roll stabilizer is preferably also designed as a hollow body, like the at least one torsion rod of a torsion spring system. The wall thickness of the torsion rods designed as a hollow body may be designed to be constant or variable over the length. The wall thickness is preferably greater in mechanically particularly stressed regions of the torsion rods, for example in the end regions, than in other regions.

In a further embodiment of the bogie according to the invention, the torsion rod of the roll stabilizer consists at least predominantly of a fiber-reinforced plastic. Additionally, at least the at least one torsion rod of the torsion spring systems of the bogie is preferably at least predominantly made of a fiber-reinforced plastic. Particularly preferably, at least the frame and/or the spring lever arms of the bogie are additionally at least predominantly made of a fiber-reinforced plastic. In this case, "at least predominantly" means that the components mentioned can also be designed as a hybrid structure, for example by using a metallic insert for force introduction, wherein the main function of torsion is carried out by the fiber-composite content.

Suitable fibers are all fibers, in particular carbon or glass or aramid fibers or a combination of the aforementioned fibers, which are able to withstand the stresses occurring during operation of the bogie. Suitable resins are all resins, in particular synthetic resins, which are able to withstand the stresses occurring during operation of the bogie. These can be readily determined by the person skilled in the art with knowledge of the inventive concept.

In other words and in summary, the solution according to the invention is based on the torsion rod, arranged transversely to the direction of travel of the bogie, of at least one roll stabilizer of the bogie being arranged in a torsionally movable manner approximately concentrically within the at least one torsion rod of a torsion spring system, which is designed for at least partial primary suspension of the bogie.

The invention is not limited to the illustrated and described embodiments but also includes all embodiments which act identically within the meaning of the invention. Furthermore, the invention is also not limited to the specifically described feature combinations but may also be defined by any other combination of particular features of all individual features disclosed overall, provided the individual features are not mutually exclusive or a specific combination of individual features is not explicitly excluded.

The invention is explained below by means of exemplary embodiments with reference to figures, without being limited thereto. In the figures, for the sake of better clarity, only one component is provided with a reference sign in each case of multiple identical components.

IN THE FIGURES

Figure 2:
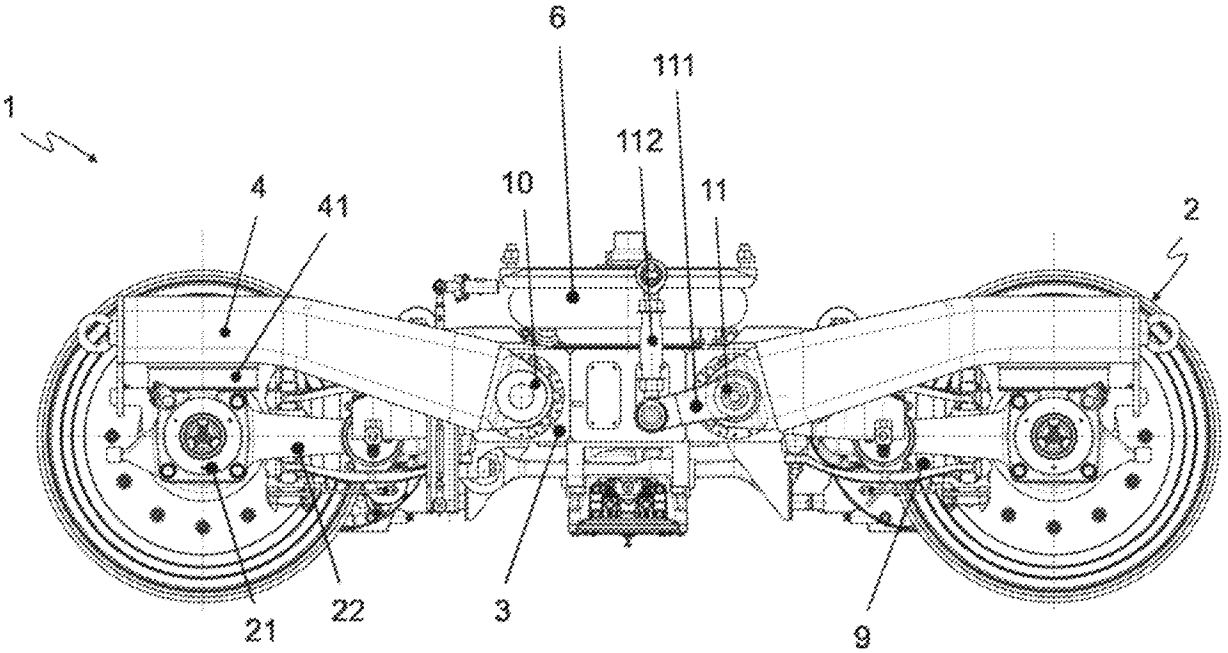
Figure 3:
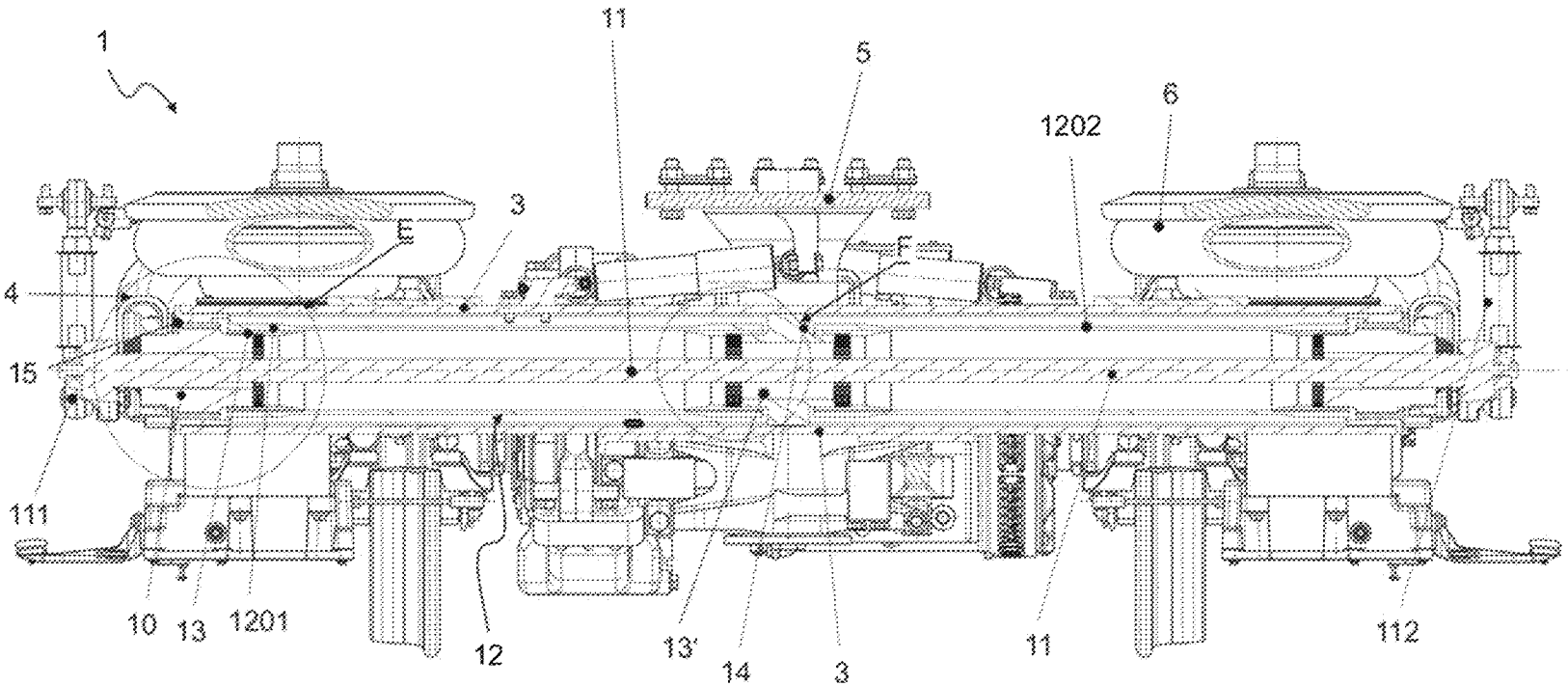
Figure 3A:
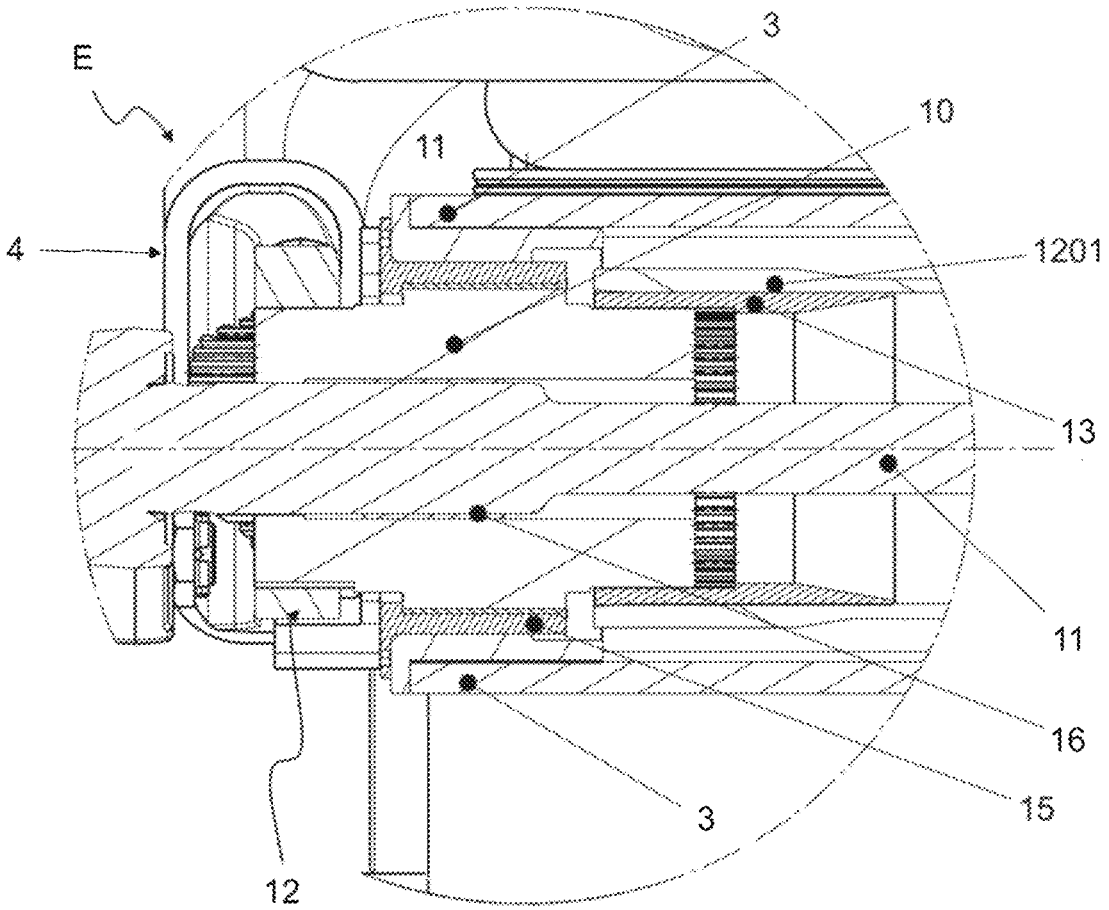
Figure 3B:
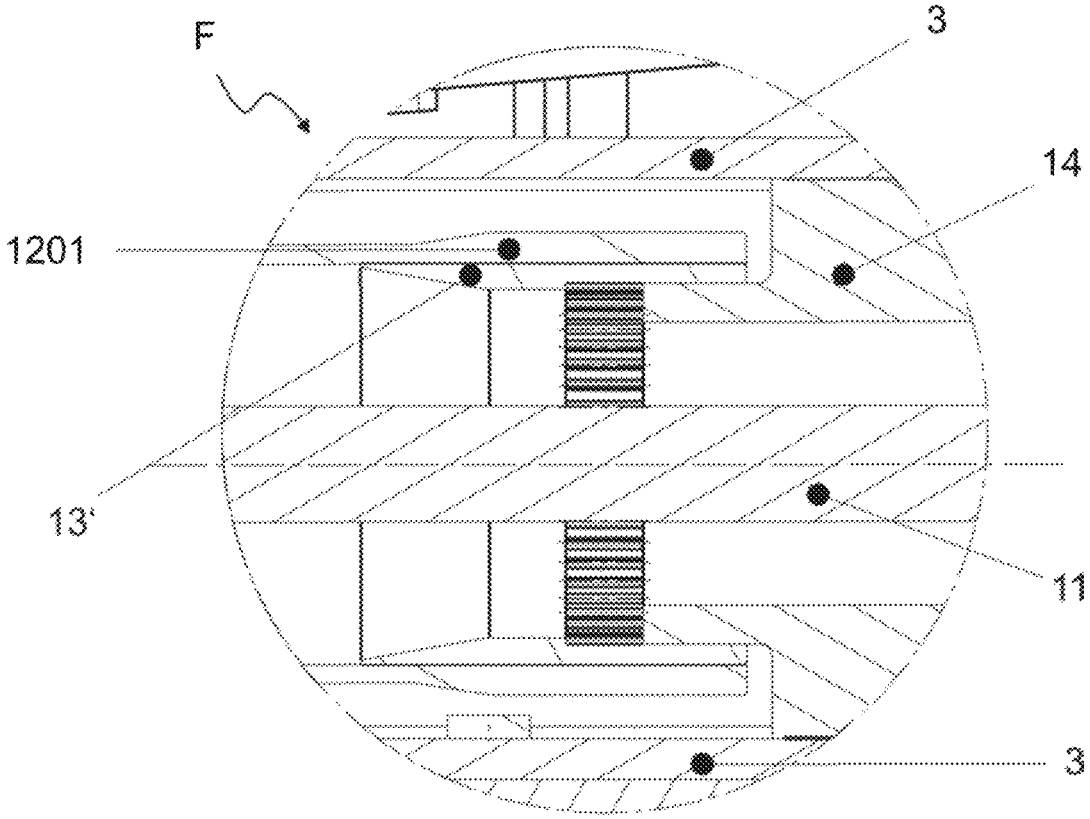
Figure 4:
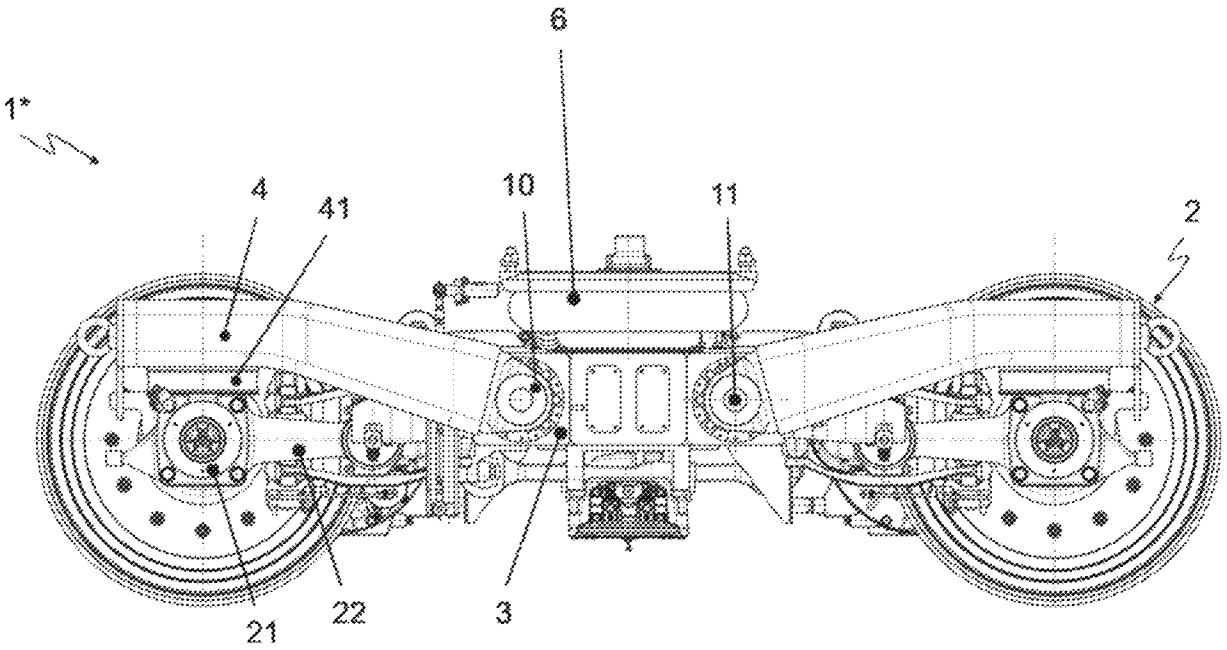
Figure 5:
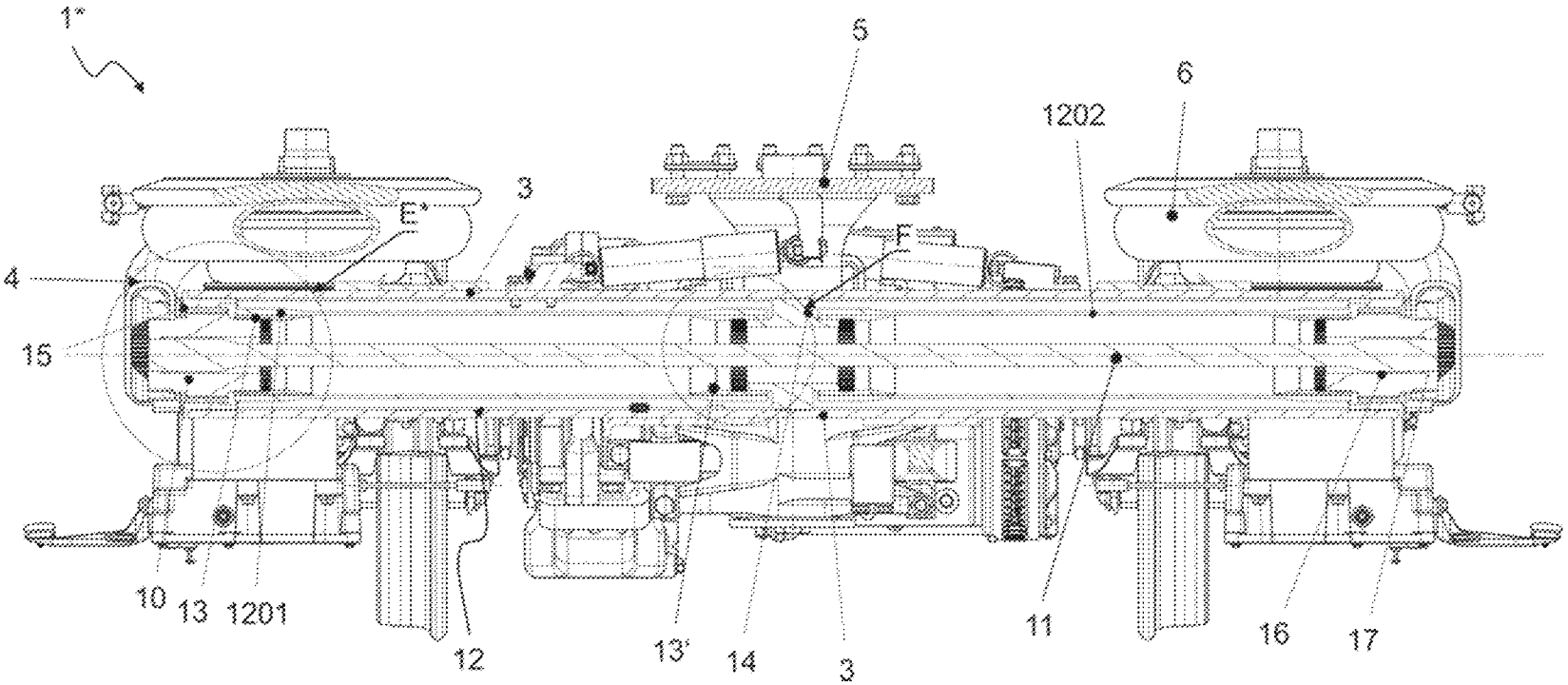
Figure 5A:
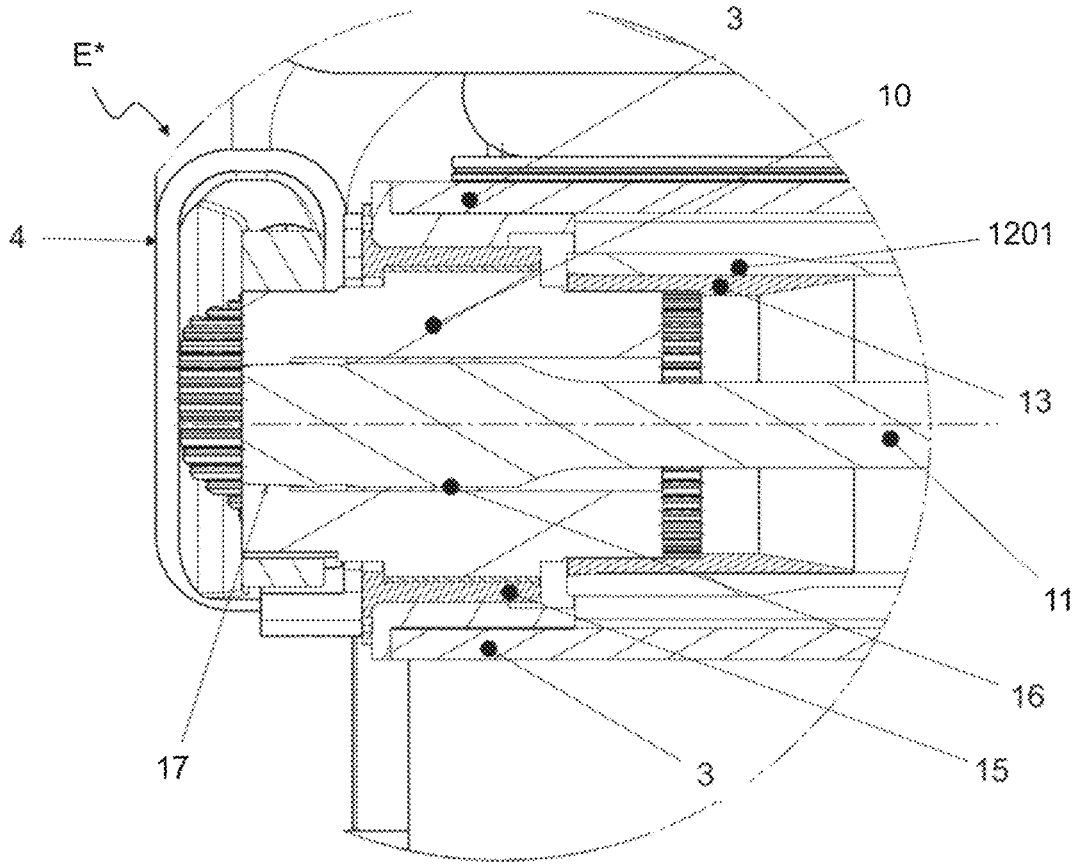
Figure 6:
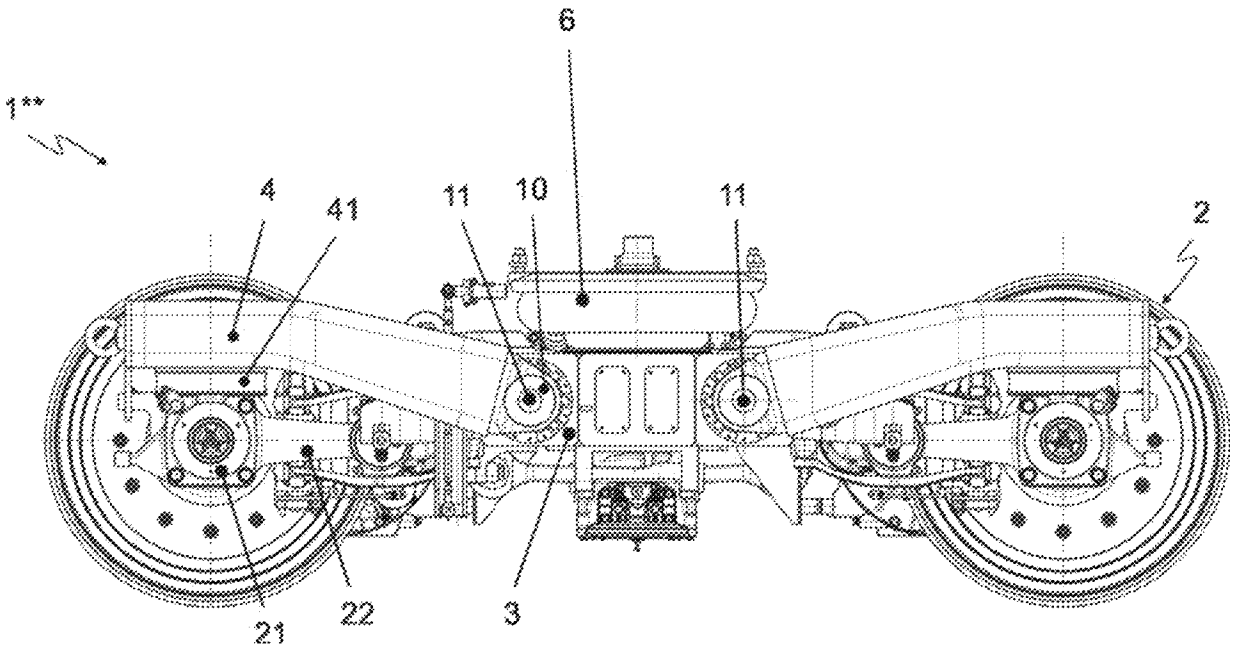

FIG. 1 shows a plan view of a bogie according to the invention for a rail vehicle, FIG. 2 shows a side view in the viewing direction Y of a bogie according to the invention with a roll stabilizer articulated to the car body (not shown), FIG. 3 shows a sectional view along the line X-X of a bogie according to the invention with a roll stabilizer articulated to the car body (not shown), FIG. 3*a* shows detail E of FIG. 3, FIG. 3*b* shows detail F of FIG. 3, FIG. 4 shows a side view in the viewing direction Y of a bogie according to the invention with a roll stabilizer articulated by the torsion spring system, FIG. 5 shows a sectional view along the line X-X of a bogie according to the invention with a roll stabilizer articulated by the torsion spring system, FIG. 5*a* shows detail E* of FIG. 5, FIG. 6 shows a side view in the viewing direction Y of a bogie according to the invention with two roll stabilizers, each articulated by a torsion spring system.

Figure 6A:
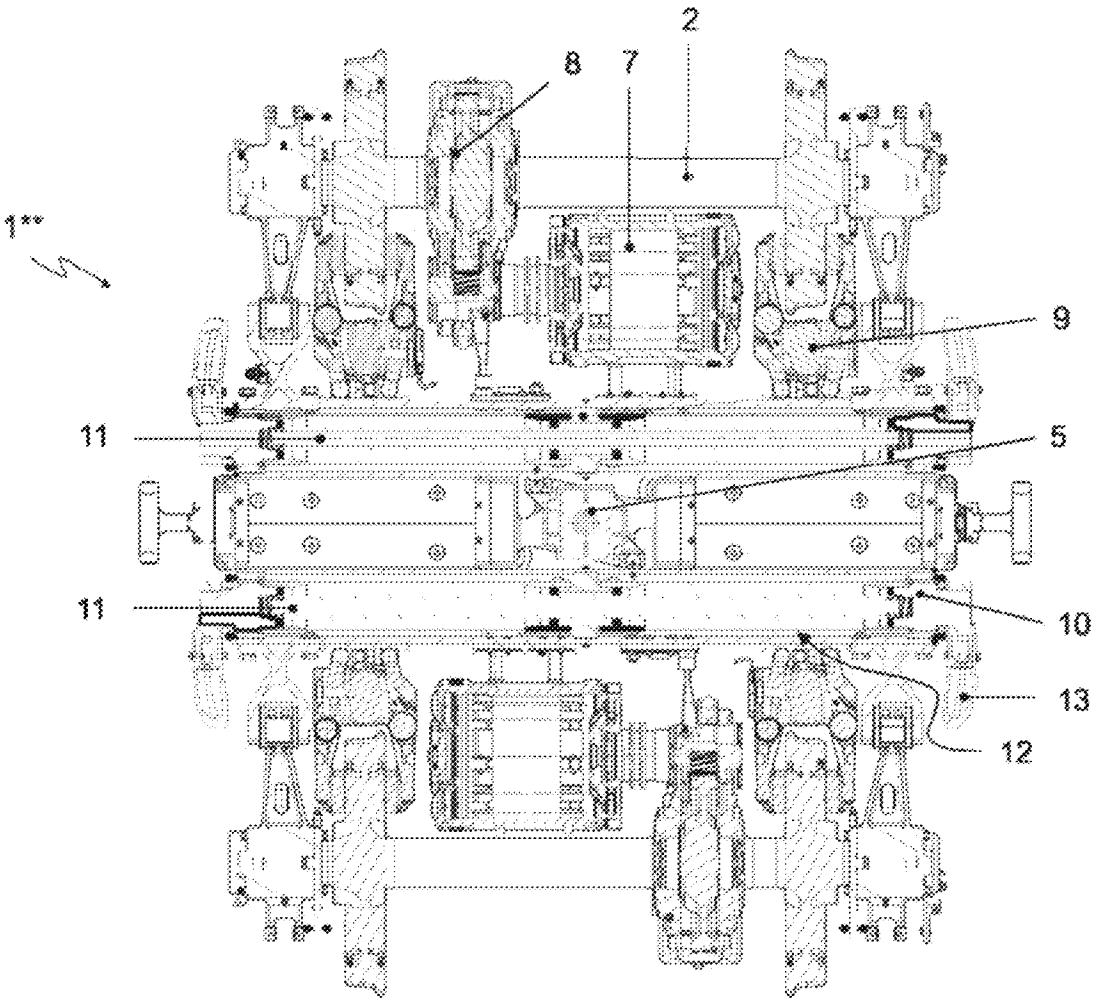

FIG. 6*a* shows a plan view of a section in the X-Y plane of the bogie according to the invention of FIG. 6.

FIG. 1 shows the plan view of an exemplary embodiment of a bogie according to the invention for a rail vehicle. The bogie 1, 1*, 1 has two wheelsets 2, each mounted in two axle bearings 21 and having two wheels 202 connected by an axle 201. Each axle bearing 21 is connected in an articulated manner to the frame 3 via an axle guide 22. For the suspension of the wheelsets 2 relative to the frame 3, the bogie 1, 1*, 1** has, per wheelset 2, a torsion spring system which is arranged parallel to the axle 201 of the corresponding wheelset 2 in the frame 3 and is thus not visible in the illustration shown. The same applies to the roll stabilizer arranged in the torsion spring system. The articulation of the roll stabilizer is not shown. On the torsion spring system, spring lever arms 4 are arranged at the end, wherein each spring lever arm 4 acts with its one end region on an axle bearing 21 by means of a damping body, e.g., a rubber pad 41. A pivot pin 5 is arranged on the frame 3 as a connection to the car body (not shown) of the rail vehicle; an elastic connection between the car body and the bogie 1, 1*, 1** is produced for the secondary suspension by air springs 6 arranged on the frame 3**.

Advantageously, the bogie 1, 1*, 1 has a particularly large amount of installation space for further operation-relevant built-in components, such as the motors 7, the transmission 8, and the brakes 9**.

In particular, the frame 3, the spring lever arms 4, the torsion spring systems, and the torsion rod of the roll stabilizer can be manufactured at least predominantly from an FRP.

FIGS. 2 and 3 show views of a bogie according to the invention analogous to that in FIG. 1, wherein the roll stabilizers are articulated to the car body (not shown).

FIG. 2 shows the side view of a bogie 1 in the viewing direction Y indicated in FIG. 1. As described above, the bogie 1 has wheelsets 2 mounted in axle bearings 21. Each axle bearing 21 is connected in an articulated manner to the frame 3 via an axle guide 22. One end region of a spring lever arm 4 acts on each axle bearing 21 via a damping body, e.g., a rubber pad 41. The other end region of the spring lever arm 4 is connected to the torsion spring system (not visible) via an, e.g. metallic, transmission shaft 10. In one of the two torsion spring systems of the bogie 1, a roll stabilizer with a torsion rod 11 is arranged, which is articulated at the end via a pendulum support arrangement having a one-sided lever 111 and a substantially vertical pendulum support 112 on opposite sides of the car body (not shown) of the rail vehicle.

FIG. 3 shows the illustration of a bogie 1 according to the invention with roll stabilizers articulated to the car body (not shown) in a section along the line X-X indicated in FIG. 1, which section corresponds to a longitudinal section along the axis of symmetry of the one of the two torsion spring systems 12 of the bogie 1 in which the torsion rod 11 of the roll stabilizer is arranged, and thus also of the torsion rod 11 of the roll stabilizer. FIG. 3*a* shows an enlarged view of detail E of FIG. 3. FIG. 3*b* shows an enlarged view of detail F of FIG. 3.

FIG. 3 shows the space-saving arrangement of the torsion spring system 12 within the frame 3. In the exemplary embodiment shown, the torsion spring system 12 comprises two torsion rods 1201 and 1202 with the same spring characteristic, which are arranged one behind the other in the axial direction, wherein the longitudinal axes, i.e., the axes with the smallest moment of inertia of the two torsion rods 1201 and 1202, coincide. In the torsion rods 1201 and 1202, an insert 13, 13', e.g. a metallic one, is arranged in each case at the end, as can be seen more precisely in FIGS. 3*a*, 3*b*. In the region, in which the insert 13, 13' rests, of the torsion rod 1201, 1202, the torsion rod 1201, 1202 is thickened, i.e., the wall thickness is increased, for example by additional fiber layers or an additional binding which surrounds the torsion rod in this region and is preferably made of a metal.

The mutually facing end regions of the torsion rods 1201 and 1202 comprise a common insert 13', i.e., the torsion rods 1201 and 1202 of the torsion spring system 12 are connected to one another via a common insert 13'. The insert 13' is non-rotatably connected to a fixed bearing 14 fastened to the frame 3, as shown in more detail in FIG. 3*b*. The inserts 13 of the other outer end regions of the two torsion rods 1201 and 1202 are fixedly connected to the transmission shaft 10 which is rotatably mounted in a radial bearing 15 fastened in the frame 3 and is connected to the spring lever arm 4, as FIG. 3*a* shows by way of example in detail for the torsion rod 1201.

The torsion rods 1201 and 1202, the inserts 13, the fixed bearing 14, and the transmission shaft 10 of the bogie 1 are designed as substantially cylindrical hollow bodies such that the torsion rod 11 of the roll stabilizer is arranged according to the invention continuously in the inner volume of the mentioned elements, wherein its longitudinal axis substantially coincides with the longitudinal axis of the elements. The torsion rod 11 of the roll stabilizer projects with its two end regions in each case beyond the transmission shaft 10 arranged there, wherein the torsion rod 11 of the roll stabilizer is guided by means of a plain bearing bush 16 through the transmission shaft 10. The torsion rod 11 of the roll stabilizer is thus rotatably mounted in the transmission shaft 10 in both end regions. In the exemplary embodiment shown, the end regions of the torsion rod 11 of the roll stabilizer are thickened, in particular where the torsion rod 11 is in contact with the plain bearing bush 16; however, the end regions may also be designed without thickening. The lever 111, which is connected to the pendulum support 112, which is articulated to the car body (not shown) of the rail vehicle, is arranged on the two regions of the torsion rod 11 of the roll stabilizer that project beyond the respective spring lever arm 4 and are designed as an axial stop.

FIG. 4 and FIG. 5 show views of a bogie 1* according to the invention analogous to that in FIG. 1, wherein the bogie 1* has exactly one roll stabilizer, which is articulated to one of the two torsion spring systems. This exemplary embodiment represents an alternative to the exemplary embodiment of a bogie 1 shown in FIGS. 2 and 3.

FIG. 4 shows the side view of a bogie 1* in the viewing direction Y indicated in FIG. 1. In addition to the components already identified in FIG. 2, in contrast to the bogie 1, the bogie 1* does not have a pendulum support arrangement for the articulation of the roll stabilizer 11 to the car body. Instead, the torsion rod 11, arranged in a space-saving manner within the torsion spring system, of the roll stabilizer is non-rotatably connected in regions to the transmission shaft 10 so that the roll stabilizer is articulated to the torsion spring system by means of the transmission shaft 10.

This is shown in more detail in FIG. 5, the illustration of the bogie 1* according to the invention in a section along the line X-X indicated in FIG. 1, or in FIG. 5*a*, which shows an enlarged view of detail E* of FIG. 5. In this exemplary embodiment too, the torsion spring system 12 arranged within the frame 3 comprises two torsion rods 1201 and 1202 with the same spring characteristic, which are arranged one behind the other in the axial direction, wherein the longitudinal axes, i.e., the axes with the smallest moment of inertia of the two torsion rods 1201 and 1202, coincide. In the torsion rods 1201 and 1202, an insert 13, 13' e.g., a metallic one, is arranged in each case at the end. In the region, in which the insert 13, 13' rests, of the torsion rod 1201, 1202, the torsion rod 1201, 1202 is thickened, i.e., the wall thickness is increased, for example by additional fiber layers or bindings. In the region of the mutually facing end regions of the torsion rods 1201 and 1202, the embodiment of the bogie 1* corresponds to the embodiment of the bogie 1 shown in FIG. 3*b*.

Likewise as in the bogie 1, in the bogie 1* too, the inserts 13 of the other outer end regions of the two torsion rods 1201 and 1202 are fixedly connected to the transmission shaft 10, which is rotatably mounted in a radial bearing 15 fastened in the frame 3 and is connected to the spring lever arm 4, as FIG. 5*a* shows by way of example in detail for the torsion rod 1201.

The torsion rods 1201 and 1202, the inserts 13, the fixed bearing 14, and the transmission shaft 10 of the bogie 1* are designed as substantially cylindrical hollow bodies such that the torsion rod 11 of the roll stabilizer is arranged according to the invention continuously in the inner volume of the mentioned elements, wherein its longitudinal axis substantially coincides with the longitudinal axis of the elements, and wherein the torsion rod 11 does not project beyond the transmission shaft 10. The two end regions, which are thickened in the exemplary embodiment shown, of the torsion rod 11 of the roll stabilizer each have an axially outer region which faces the spring lever arm 4 and is non-rotatably connected in a force-fitting or a force-fitting and form-fitting manner, e.g., via a toothing 17, to the transmission shaft 10. Further inward, the toothing 17 is adjoined in the axial direction by a non-toothed region of the torsion rod 11, which is guided, for example by means of a plain bearing bush 16, through the transmission shaft 10. Both the torsion spring system 12 and the torsion rod 11 of the roll stabilizer are accordingly in each case non-rotatably connected at the end to the respective transmission shaft 10 so that the roll stabilizer is articulated to the torsion spring system 12 by means of the transmission shaft 10.

FIG. 6 shows the side view of a bogie 1 according to the invention in the viewing direction Y indicated in FIG. 1, wherein the bogie 1** only differs from the bogie 1* in that the torsion rod 11 of a roll stabilizer is arranged in each of its two torsion spring systems (not visible), i.e., it has two roll stabilizers which are each articulated to a torsion spring system by means of a transmission shaft 10**.

FIG. 6*a* shows the plan view of a section in the X-Y plane (shown in FIG. 1) of the bogie 1 according to the invention with the pivot pin 5. A torsion rod 11 of a roll stabilizer is in each case arranged in each torsion spring system 12 respectively assigned to a wheelset 2. Each torsion spring system 12 is in each case connected at the end via an insert 13 to an associated, rotatably mounted transmission shaft 10. The torsion rod 11 of the roll stabilizer is non-rotatably connected in a force-fitting or force-fitting and form-fitting manner to the two transmission shafts 10 arranged at the ends and, on its two end regions, is articulated to the torsion spring system 12 by means of said transmission shafts. The bogie 1** advantageously has a particularly large amount of installation space for the arrangement of components, such as the motors 7, the transmissions 8, and the brakes 9**.

REFERENCE SIGNS

1, 1*, 1** Bogie
2 Wheelset
201 Axle
202 Wheel
21 Axle bearing
22 Axle guide
3 Frame
4 Spring lever arm
41 Rubber pad
5 Pivot pin
6 Air spring
7 Motor
8 Transmission
9 Brake
10 Transmission shaft
11 Torsion rod of the roll stabilizer
111 Lever
112 Pendulum support
12 Torsion spring system
1201 Torsion rod of the torsion spring system
1202 Torsion rod of the torsion spring system
13, 13' Insert
14 Fixed bearing
15 Radial bearing
16 Plain bearing bush
17 Toothing

The invention claimed is:

1. A bogie for a rail vehicle with at least two wheelsets mounted in axle bearings and with at least one frame, wherein each of the two axle bearings of a wheelset is connected in an articulated manner to the frame via an axle guide, comprising at least two torsion spring systems which are arranged parallel to the axles of the wheelsets and each of which has at least one region in which they are non-rotatably connected to the frame, wherein each torsion spring system has two spring lever arms such that the end region, not connected to the torsion spring system, of a spring lever arm acts on the axle bearing, wherein the bogie has at least one roll stabilizer, comprising a torsion rod which is arranged in a torsionally movable manner in the inner volume of at least one of the torsion spring systems, and the torsion rod of the roll stabilizer is articulated to the torsion spring system, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

2. The bogie according to claim 1, wherein the end regions of the torsion rod of the roll stabilizer project beyond the torsion spring system and the torsion rod of the roll stabilizer is in each case articulated to mutually opposite outer sides of the car body of the rail vehicle via a pendulum support arrangement arranged at the end.

3. The bogie according to claim 2, wherein the torsion rod of the roll stabilizer is manufactured at least predominantly from a fiber-reinforced plastic.

4. The bogie according to claim 3, wherein the at least one torsion rod of each torsion spring system, or the frame, or the spring lever arms, or a combination of the aforementioned components is at least predominantly manufactured from a fiber-reinforced plastic.

5. The bogie according to claim 4, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

6. The bogie according to claim 3, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

7. The bogie according to claim 1, wherein the torsion rod of the roll stabilizer is at least indirectly connected in its two end regions to the torsion spring system via a force fit or a force fit and form fit.

8. The bogie according to claim 7, wherein the torsion rod of the roll stabilizer is manufactured at least predominantly from a fiber-reinforced plastic.

9. The bogie according to claim 8, wherein the at least one torsion rod of each torsion spring system, or the frame, or the spring lever arms, or a combination of the aforementioned components is at least predominantly manufactured from a fiber-reinforced plastic.

10. The bogie according to claim 9, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

11. The bogie according to claim 7, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

12. The bogie according to claim 1, wherein the torsion rod of the roll stabilizer is manufactured at least predominantly from a fiber-reinforced plastic.

13. The bogie according to claim 12, wherein the at least one torsion rod of each torsion spring system, or the frame, or the spring lever arms, or a combination of the aforementioned components is at least predominantly manufactured from a fiber-reinforced plastic.

14. The bogie according to claim 13, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

15. The bogie according to claim 12, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

16. The bogie according to claim 1, wherein the torsion rod of the roll stabilizer is manufactured at least predominantly from a fiber-reinforced plastic.

17. The bogie according to claim 16, wherein the at least one torsion rod of each torsion spring system, or the frame, or the spring lever arms, or a combination of the aforementioned components is at least predominantly manufactured from a fiber-reinforced plastic.

18. The bogie according to claim 17, wherein, in the two end regions and in the region of half the height of the torsion spring system, an insert is non-rotatably connected to the torsion spring system, wherein in the region of half the height of the torsion spring system, the insert is non-rotatably mounted in a fixed bearing arranged in the frame, and wherein the respective one insert is non-rotatably connected in one of the two end regions of the torsion spring system to a transmission shaft which in turn is rotatably mounted in a radial bearing arranged in the frame and is connected to the associated spring lever arm, and wherein at least the torsion spring system, the inserts, the fixed bearing, and the transmission shaft are designed as a hollow body such that the torsion rod of the roll stabilizer is arranged continuously in the inner volume thereof, wherein the torsion rod of the roll stabilizer is in each case in its end region non-rotatably connected to the transmission shaft by means of a press connection or toothing so that the roll stabilizer is articulated by means of the transmission shaft to the torsion spring system.

* * * * *